US010315094B2

(12) United States Patent
Pravata

(10) Patent No.: US 10,315,094 B2
(45) Date of Patent: Jun. 11, 2019

(54) MULTI-SURFACE GOLF SWING TRAINING MAT AND ASSOCIATED USE THEREOF

(71) Applicant: Charles Pravata, Levittown, NY (US)

(72) Inventor: Charles Pravata, Levittown, NY (US)

( * ) Notice: Subject to any disclaimer, the term of this patent is extended or adjusted under 35 U.S.C. 154(b) by 0 days.

(21) Appl. No.: 15/795,555

(22) Filed: Oct. 27, 2017

(65) Prior Publication Data

US 2018/0117439 A1 May 3, 2018

Related U.S. Application Data

(60) Provisional application No. 62/414,009, filed on Oct. 28, 2016.

(51) Int. Cl.
*A63B 69/36* (2006.01)

(52) U.S. Cl.
CPC ..... *A63B 69/3661* (2013.01); *A63B 2209/00* (2013.01); *A63B 2209/10* (2013.01); *A63B 2210/50* (2013.01)

(58) Field of Classification Search
CPC ..... A63B 69/36; A63B 67/02
See application file for complete search history.

(56) References Cited

U.S. PATENT DOCUMENTS 3,712,628 A * 1/1973 Boss, Jr. ..... A63B 69/3661 473/279
3,735,988 A * 5/1973 Palmer ..... A63B 67/02 428/17
4,928,966 A 5/1990 Miller
5,156,398 A * 10/1992 Kibamoto ..... A63B 69/3661 473/278
5,645,494 A * 7/1997 Dionne ..... A63B 69/3667 473/270
6,106,409 A * 8/2000 Jackson, Jr. ..... A63B 69/3661 473/278
6,312,345 B1 * 11/2001 Pelz ..... A63B 69/0057 473/150
8,852,017 B2 10/2014 Zambrello
9,586,121 B1 * 3/2017 Carlson ..... A63B 69/3661
2003/0109325 A1 * 6/2003 Carlton ..... A63B 69/3652 473/278

* cited by examiner

*Primary Examiner* — Eugene L Kim
*Assistant Examiner* — Christopher A Glenn
(74) *Attorney, Agent, or Firm* — Michael J. Porco

(57) ABSTRACT

A multi-surface golf swing training mat is provided for use at practice ranges and the like. The mat includes four surfaces (e.g., quads or squares) that simulate surfaces actually found on a golf course: the drive or tee-box, the fairway, the sand, and the 3-inch rough. The multi-surface golf swing training mat enables practicing golfers to work not only on their swing, but also on hitting shots from surfaces similar to those on which they will be playing. In one aspect of the present disclosure, the golfer stands beside the multi-surface golf swing training mat to hit balls from the two nearest hitting squares, and stands on the mat to hit balls from the other two squares. In another aspect, the multi-surface golf swing training mat rotates to present each playing square or surface to a golfer from a single standing position.

18 Claims, 11 Drawing Sheets

MULTI-SURFACE GOLF SWING TRAINING MAT AND ASSOCIATED USE THEREOF

PRIORITY

This application claims priority to U.S. Provisional Patent Appl. No. 62/414,009 filed Oct. 28, 2016, entitled "MULTI-SURFACE GOLF SWING TRAINING MAT AND ASSOCIATED USE THEREOF", the contents of which are hereby incorporated by reference in its entirety.

BACKGROUND

Field

Exemplary embodiment(s) of the present disclosure relate to golf training aides and, more particularly, to a multi-surface golf swing training or practice mat primarily for use at practice ranges and for providing four surfaces (e.g., quads or squares) simulating surfaces actually found on a golf course: the drive or tee-box, the fairway, the sand, and the 3-inch rough. This enables practicing golfers to work not only on their swing, but also on hitting shots from surfaces similar to those on which they will be playing.

Description of the Related Art

Consider, for a moment, one of the differences between golf and tennis. In tennis, the developing player must learn to hit the ball with a variety of almost completely different strokes: the forehand and backhand, the serve, the forehand and backhand volley, the overhead. In golf, on the other hand, almost all the shots—except for putts—are variations on one basic, all important swing. A player's stance will change depending on the length and loft of the club, and on the intended direction of the shot; but his (or her) swing won't change much, if at all. Thus, in golf, one's development depends primarily on acquiring a smooth, consistent, relaxed and powerful swing—a swing that, given the necessary variations in stance, club-length, and shot direction, can be repeated with every club. Even in a short pitch-and-roll to the green, while the swing is vastly shortened, the general arc that the club head follows is the same.

Ben Hogan's classic teaching manual, *Five Lessons: The Modern Fundamentals of Golf*, expressed the champion's belief that the acquisition of a smooth, repeating swing was the key to it all. As with any top-flight athletic performance, of course, the pros make it look incredibly smooth, natural and easy. But there is nothing inherently "natural" about a great golf swing: it only appears so to us after its possessor has made it natural through thousands of hours—and tens of thousands of practice balls—that established a channel, a groove, for his or her swing. And while there is no way to acquire a dependable, repeating golf swing without lots of practice, the situation in golf is further complicated by the fact that the player must hit the ball from a variety of surfaces—surfaces that vary from the short grass of the fairway to the long grass of the rough, and from the elevated position of the ball on the tee to the sand of the bunker, where the ball may be obscured or even buried. The golfer must not only require that smooth, repeating swing, then, but use it to hit the ball from an endless variety of lies. This too requires hours and hours of practice.

Accordingly, a need remains for multi-surface golf swing training or practice mat to overcome at least one aforementioned shortcoming.

SUMMARY

The present disclosure provides a multi-surface golf swing training or practice mat primarily for use at practice ranges and for providing four surfaces (e.g., quads or squares) like those actually found on a golf course: the drive or tee-box, the fairway, the sand, and the 3-inch rough. The exemplary embodiment(s) provide a multi-surface golf swing practice mat primarily for use at practice ranges and the like (e.g., for personal use at home) that is convenient and easy to use, lightweight yet durable in design, versatile in its applications, and designed for providing four surfaces (e.g., quads or squares) that simulate the surfaces actually found on the golf course. The multi-surface golf swing training mat enables practicing golfers to work not only on their swing, but also on hitting shots from surfaces similar to those on which they will be playing, in accordance with non-limiting exemplary embodiment(s) of the present disclosure.

In one aspect of the present disclosure, a multi-surface golf swing training mat is provided including: a first surface configured to simulate a tee-box portion of a golf course, the first surface including simulated grass of a first predetermined height; a second surface configured to simulate a fairway portion of the golf course, the second surface including simulated grass of a second predetermined height; a third surface configured to simulate a rough portion of the golf course, the third surface including simulated grass of a third predetermined height, wherein the second predetermined height is greater than the first predetermined height and the third predetermined height is greater than the first and second predetermined heights; a fourth surface configured to simulate a bunker portion of the golf course; and a frame configured to receive the first, second, third, and fourth surfaces such that a generally rectangular shape is formed with the first, second, third, and fourth surfaces being in a two-by-two arrangement.

In another of the present disclosure, the multi-surface golf swing training mat includes a platform including a rotation mechanism, the rotation mechanism coupled to a portion of the frame such that the frame is rotatable relative to the platform.

In another of the present disclosure, the multi-surface golf swing training mat includes wherein the rotation mechanism is spring loaded.

In another of the present disclosure, the multi-surface golf swing training mat includes wherein the platform includes a standing portion, a recessed portion, the standing portion including a surface for a user to stand on and the recessed portion configured to receive the frame such that the first, second, third, and fourth surfaces are substantially the same height from the ground as the surface of the standing portion.

In another of the present disclosure, the multi-surface golf swing training mat includes wherein the frame includes four sides and an edge is formed between the standing portion and the recessed portion of the platform such that when any one of the four sides of the frame is in contact with the edge the frame is not rotatable.

In another of the present disclosure, the multi-surface golf swing training mat includes wherein to rotate the frame, one of the four sides that is in contact with the edge is lifted to enable the frame to be rotated.

In another of the present disclosure, the multi-surface golf swing training mat includes at least one engaging member coupled to the frame, the at least one engaging member configured to enable the one of the four sides in contact with the edge to be lifted and the frame to be rotated by engaging the engaging member with a head of a golf club.

In another of the present disclosure, the multi-surface golf swing training mat includes wherein the engaging member is configured as a hook.

In another of the present disclosure, the multi-surface golf swing training mat includes wherein the fourth surface includes a lip defining an indented portion, the indented portion configured to be filled with a first material, the first material being at least one of sand or a material simulating sand.

In another of the present disclosure, the multi-surface golf swing training mat includes a lid configured to be placed over the lip to retain the first material within the indented portion of the fourth surface.

In another of the present disclosure, the multi-surface golf swing training mat includes wherein the lid and lip each include coupling mechanisms configured to detachably couple the lid and lip to each other.

In another of the present disclosure, the multi-surface golf swing training mat includes wherein the lid includes a protrusion configured to partially extend into the indented portion to seal the first material in the indented portion.

In another of the present disclosure, the multi-surface golf swing training mat includes wherein the frame includes a first portion configured to receive the first surface, a second portion configured to receive the second surface, a third portion configured to receive the third surface, and a fourth portion configured to receive the fourth surface, wherein the first, second, third, and fourth portions of the frame are coupled together via a flexible material configured to enable the frame to be folded into a compact structure.

In another of the present disclosure, the multi-surface golf swing training mat includes wherein the frame includes a first portion configured to receive the first surface, a second portion configured to receive the second surface, a third portion configured to receive the third surface, and a fourth portion configured to receive the fourth surface, wherein the first, second, third, and fourth portions of the frame are detachably coupled.

In another of the present disclosure, the multi-surface golf swing training mat includes wherein each portion of the frame includes four sides and two adjacent sides of each portion include a detachable coupling mechanism to enable the first, second, third, and fourth portions of the frame to be detachably coupled.

In another of the present disclosure, the multi-surface golf swing training mat includes at least one wedge configured to be placed underneath any one of the first, second, third, and forth surfaces, the at least one wedge configured to change the angle of at least a portion of the first, second, third, or fourth surfaces relative to a surface the multi-surface golf swing training mat is placed on.

In another of the present disclosure, the multi-surface golf swing training mat includes at least one wedge configured to be placed underneath any one of the first, second, and third surfaces, the at least one wedge configured to impart a curved shape to at least a portion of the first, second, or third surfaces.

In another of the present disclosure, the multi-surface golf swing training mat includes wherein the simulated grass of each of the first, second, and third surface is made of artificial turf.

In another of the present disclosure, the multi-surface golf swing training mat includes wherein the first, second, third, and fourth surfaces are each underlain by a support layer configured to simulate dirt and provide support to each of the surfaces.

In another of the present disclosure, the multi-surface golf swing training mat includes wherein the frame is made of a rigid material and includes four slots, each slot configured to receive a respective one of the first, second, third, and fourth surfaces.

BRIEF DESCRIPTION OF THE DRAWINGS

The above and other aspects, features, and advantages of the present disclosure will become more apparent in light of the following detailed description when taken in conjunction with the accompanying drawings in which.

Figure 1:
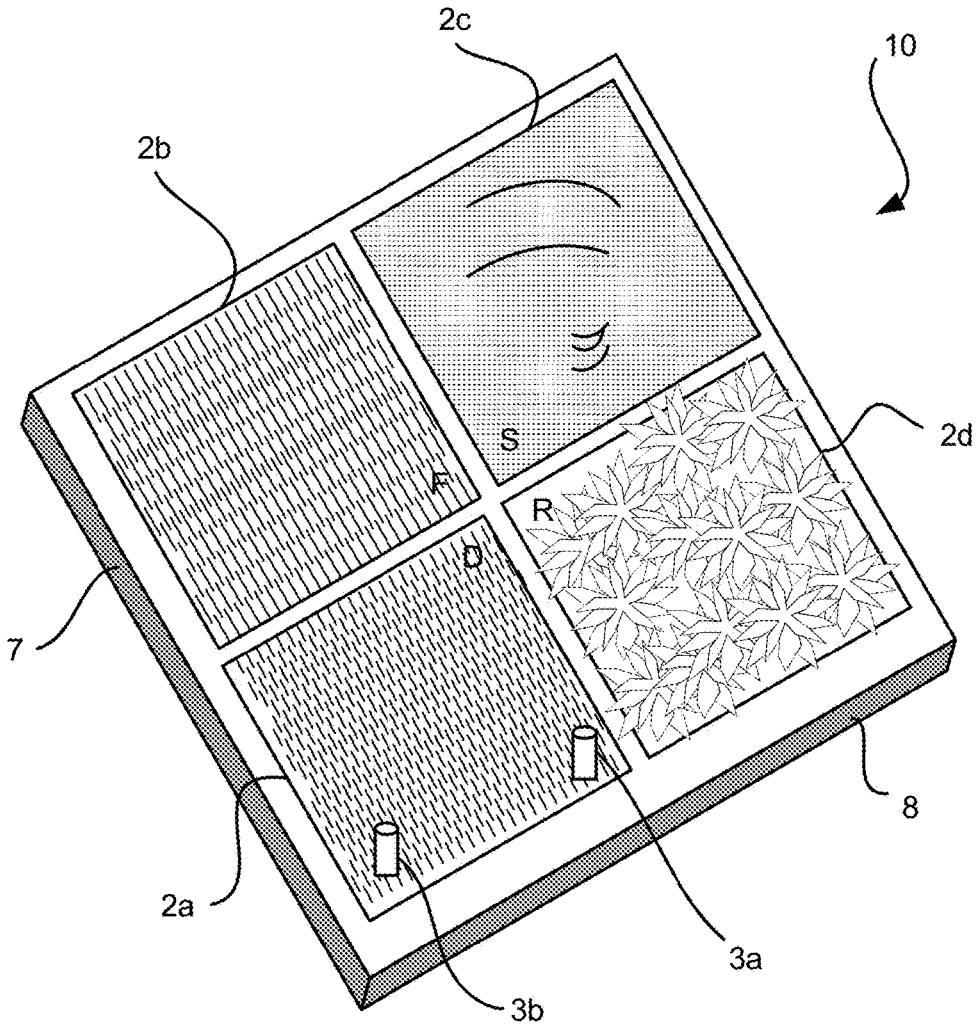
FIG. 1 is a perspective view of a multi-surface golf swing training mat in accordance with an embodiment of the present disclosure.

It should be understood that the drawing(s) is for purposes of illustrating the concepts of the disclosure and is not necessarily the only possible configuration for illustrating the disclosure.

DETAILED DESCRIPTION

Preferred embodiments of the present disclosure will be described hereinbelow with reference to the accompanying drawings. In the following description, well-known functions or constructions are not described in detail to avoid obscuring the present disclosure in unnecessary detail. Herein, the phrase "coupled" is defined to mean directly connected to or indirectly connected with through one or more intermediate components.

All examples and conditional language recited herein are intended for educational purposes to aid the reader in understanding the principles of the disclosure and the concepts contributed by the inventor to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Figure 2:
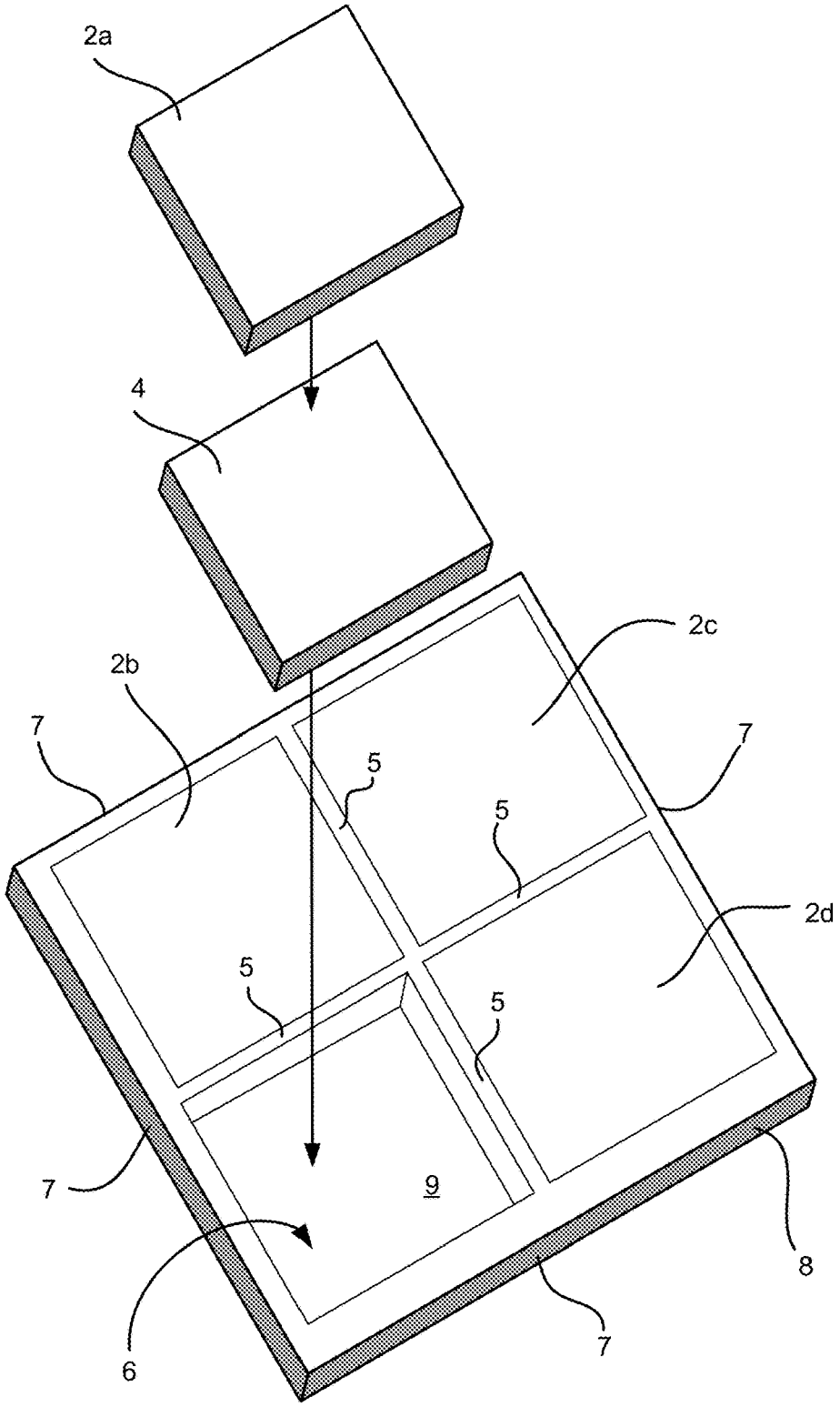
FIG. 2 is a perspective view of the multi-surface golf swing training mat as shown in FIG. 1 with at least one surface shown in an exploded view.

Referring to FIGS. 1 and 2, a multi-surface golf swing training or practice mat 10 is shown in accordance with the present disclosure. Mat 10 is primarily for use at practice ranges and for providing four surfaces (e.g., quads or squares) configured to simulate surfaces found on a golf course: the drive or tee-box, the fairway, the sand, and the 3-inch rough. This enables practicing golfers to work not only on their swing, but also on hitting shots from surfaces similar to those on which they will be playing. It should be understood that the exemplary embodiment(s) may be used to in a variety of environments, and should not be limited to only a practice range described herein.

Mat 10 includes four hitting surfaces 2*a*-2*d* designed to closely simulate those found on an actual golf course: a tee-box surface 2*a*, for drives and other tee shots; a short turf-like surface 2*b* simulating a groomed fairway; a 3-inch grass-like surface 2*c* simulating the rough; and a sand-like surface 2*d* simulating a bunker. The multi-surface mat 10 may be square (e.g., in one embodiment, an 8'×8' square) or rectangular, and sub-divided into four equally-sized square or rectangular sections or slots 6 with the four different hitting surfaces 2*a*-2*d*. It is to be appreciated that FIG. 1 illustrates the texture of each surface; however, in other figures, the texture might not be shown for clarity of the individual figure.

In one embodiment, the tee-box surface 2*a*, fairway surface 2*b*, and rough surface 2*d* are surfaced in artificial turf corresponding in length and density to their actual on-course counterparts, and underlain by a shock-pad or intermediate support layer 4. The tee box surface 2*a* may include one or more permanently mounted rubber tees 3*a*, 3*b*, disposed at various locations on surface 2*a* to accommodate both left-handed and right-handed players. In another embodiment, tees 3*a*, 3*b* may be non-permanent and movable and may be disposed, by a golfer, at any desired position on tee box surface 2*a*. In one embodiment, the support layer 4 is made of a rubber or foam material configured to simulate the firmness of the dirt under the grass that would be felt by a player walking through a golf course. In some embodiments, surfaces 2 and layers 4 are fixedly coupled and configured as one component. In other embodiments, surfaces 2 and layers 4 are separate components.

Figure 2A:
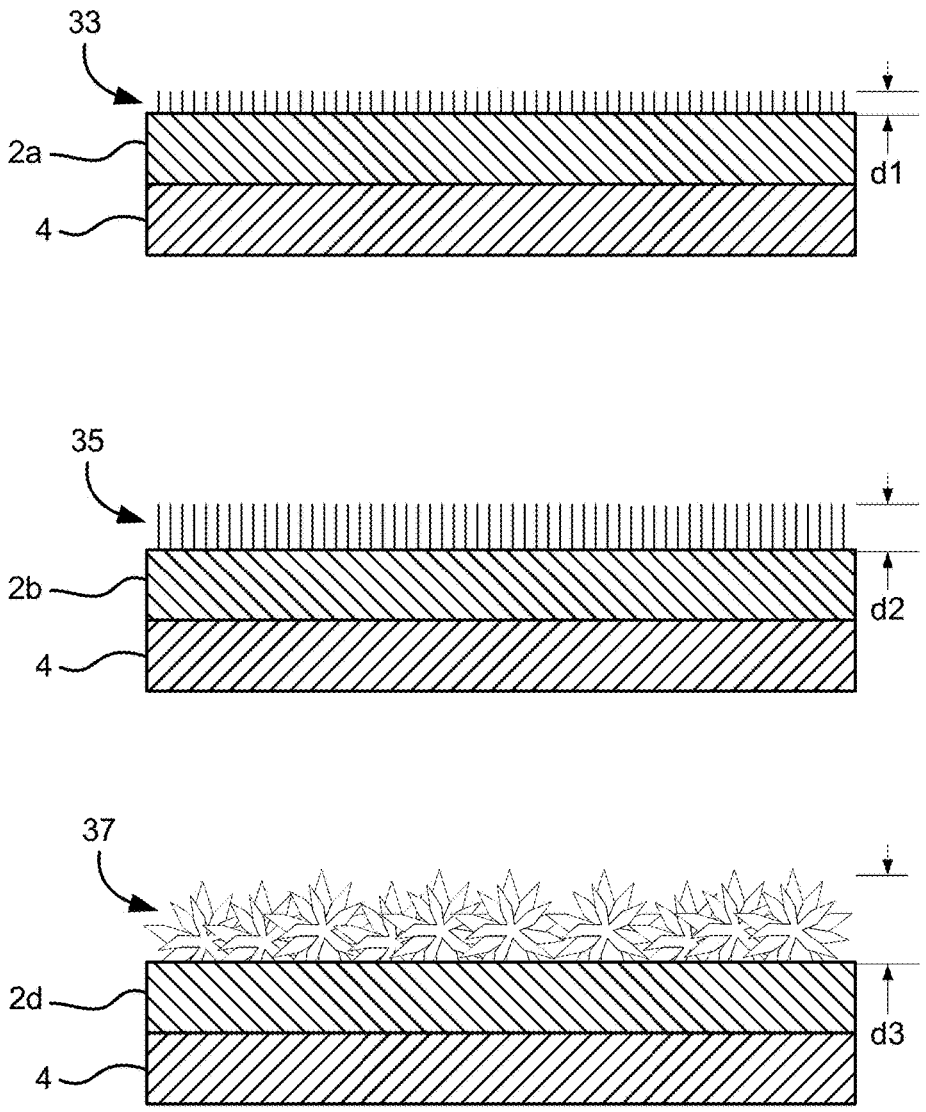
FIG. 2A illustrates differing heights of turf or simulated grass for various surfaces of the multi-surface golf swing training mat in accordance with an embodiment of the present disclosure.

It is to be appreciated that at least the tee-box surface 2*a*, fairway surface 2*b*, and/or rough surface 2*d* include simulated grass. For example, in one embodiment, each of surfaces 2*a*, 2*b*, 2*d* are surfaced in artificial turf or another grass-like structure which may include a surface of synthetic fibers made to look like and react like natural grass. It is further to be appreciated that the turf or synthetic grass of the tee-box surface 2*a*, fairway surface 2*b*, and rough surface 2*d* are configured at different heights to closely simulate their actual counterparts of an actual golf course, as shown in FIG. 2A. For example, the tee-box surface 2*a* may be configured with turf or simulated grass 33 at a first predetermined height d1 of, for example, about 0.4. inches or less; the fairway surface 2*b* may be configured with turf or simulated grass 35 at a second predetermined height d2 of, for example, about 0.5. inches to about 0.75 inches; and the rough surface 2*d* may be configured with turf, simulated grass, etc. 37 at a third predetermined height d3 of, for example, about 2.00 inches or higher. It is to be appreciated that the above-mentioned heights for the first, second and third predetermined height of the turf or blades of grass are merely exemplary and other heights are to be considered to be within the scope of the present disclosure. However, to most closely resemble their actual golf course counterparts, in one embodiment, the predetermined heights may be configured as follows: $1^{st}$ predetermined height<$2^{nd}$ predetermined height<$3^{rd}$ predetermined height. In this manner, the turf or synthetic grass of the tee-box surface 2*a*, fairway surface 2*b*, and rough surface 2*d* will simulate the various conditions and surfaces of an actual golf course.

Figure 3:
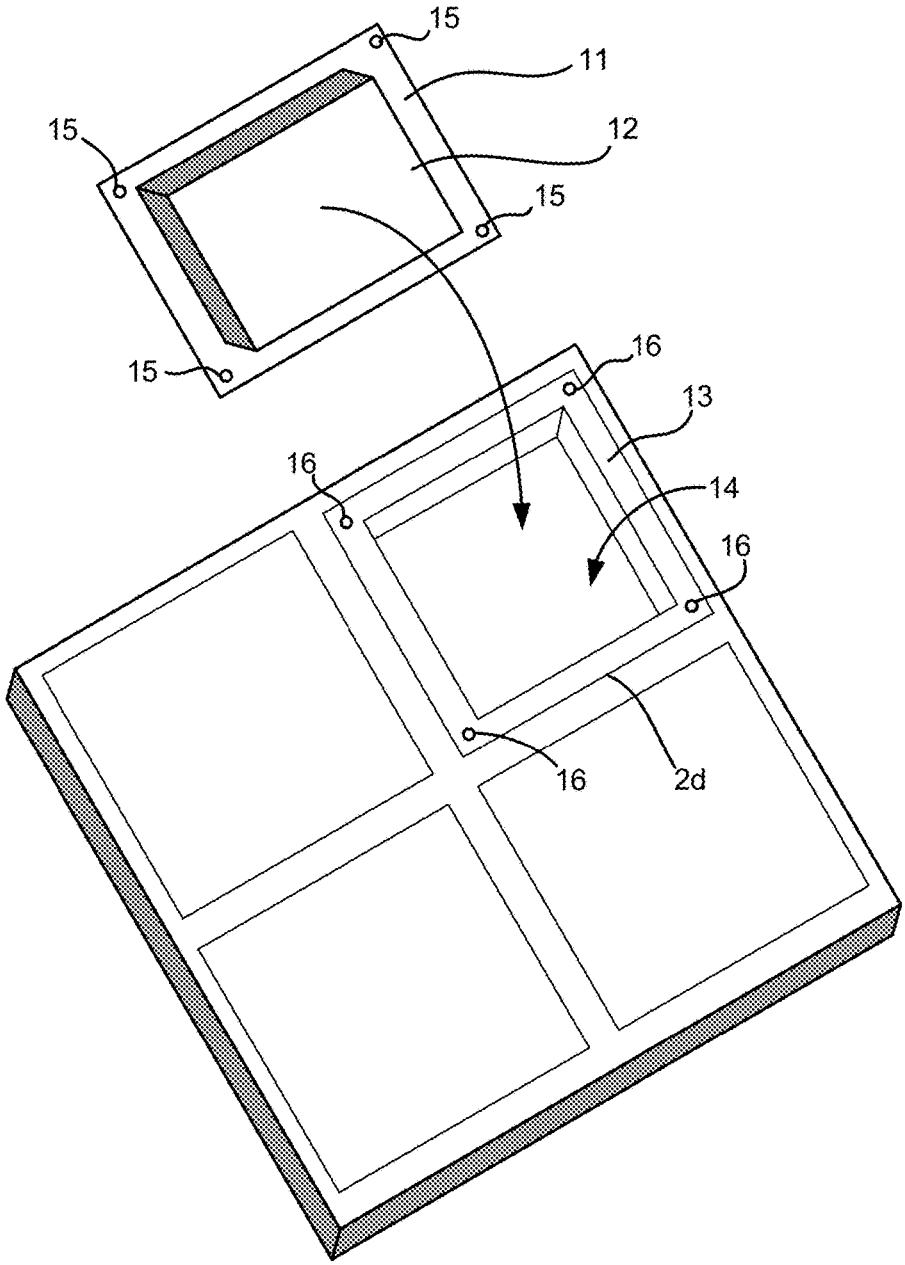
FIG. 3 is a perspective view of a portion of a multi-surface golf swing training mat with a lid in accordance with an embodiment of the present disclosure.

Referring to FIG. 3, in one embodiment, the bunker surface or section 2*c* of the multi-surface mat 10 is configured with a rubber retaining lip or border 13 (e.g., 8 to 10 inches in height (and also underlain by shock-pad 4)) defining an indented portion or slot 14. This indented portion or slot 14 is configured to be filled with a sand or a sand-like material to simulate a real sand feel. For example, the sand-like material may be a plurality of rubber, foam or similar material pieces configured into relatively small chunks (e.g., pieces smaller than a conventional golf ball) loosely disposed in portion or slot 14 to allow a golfer to swing through the loosely deposited material to simulate swinging through sand or the like. In another embodiment, the sand-like material may be metal beads linked by metal, nylon, or any other suitable material, as shown and described in U.S. Pat. No. 8,852,017, the contents of which are incorporated by reference. As shown in FIG. 3, the bunker surface or section 2*c* may include a lid or cover 11 configured to be placed over lip 13 to retain the sand or sand-like material disposed in indented portion 14 while bunker surface or section 2*c* is not in use. Lid or cover 11 may include one or more coupling mechanisms 15 configured to interact with coupling mechanisms 16 of lip 13 such that lid 11 is detachably coupled to lip 13. For example, the coupling mechanisms 15, 16, may be magnets or other suitable coupling mechanisms.

In one embodiment, a portion of lid 11 may include a protrusion 12 configured with substantially the same shape as indented portion 14, such that, when lid 11 is placed over lip 13, protrusion 12 is at least partially disposed in indented portion 14 to seal the sand or sand-like material within indented portion 14.

Referring again to FIGS. 1 and 2, in one embodiment, frame 8 includes four rigid walls 7 to form a generally square or rectangular shape. It is to be appreciated that frame 8 may be made of a light-weight, rigid material, such as, plastic. Frame 8 may further include one or more partitions 5 disposed within the enclosure formed by walls 7. The partitions 5 form indented portions or slots 6 having substantially the same shape as surfaces 2 and support layers 4, where each slot 6 is configured to receive a corresponding surface 2 and support layer 4. When each surface 2/support layer 4 is disposed in a corresponding slot 6, a substantially square or rectangular two-by-two arrangement of surfaces 2 (e.g., surface 2*a*, 2*b*, 2*c*, 2*d*) is achieved, as shown in FIG. 1.

In one embodiment, frame 8 may additionally include a floor or surface 9, configured to further support each surface 2 and support layer 4. It is to be appreciated that mat 10 is made of sufficiently light materials to enable mat 10 to be portably transported to golfing practice facilities, such as, driving-ranges.

In use, mat 10 is placed on the ground and the golfer stands adjacent to one of the four sides of mat 10 to hit balls from the two nearest adjacent surfaces to the side (e.g., surfaces 2*a* and 2*b*, 2*b* and 2*c*, 2*c* and 2*d*, and 2*a* and 2*d*), and on the mat to hit balls from the other two surfaces 2. For example, a golfer may stand on the ground along the side of the mat which includes surfaces 2*a* and 2*b*, where the golfer may practice their swing on surface 2*a* for a tee shot and on surface 2*b* for a fairway shot. Then, to utilize the surfaces 2*d* and 2*c*, the golfer may stand on surfaces 2*a* and 2*b*. While standing on surfaces 2*a* and 2*b*, the golfer may practice a swing from the rough on surface 2*d* and a bunker shot from surface 2*c*.

In one embodiment, mat 10 includes a platform, where frame 8 is rotatable relative to the platform. In this way, a golfer using mat 10 does not need to change his/her standing position relative to the mat 10 to use different surfaces 2 of mat 10. For example, referring to FIGS. 4 and 5, a mat 100 including a platform 20 configured to enable frame 8 to rotate relative to the platform 20 via a rotation mechanism 30 is shown in accordance with an embodiment of the present disclosure. In one embodiment, the mechanism 30 includes one or more ball bearings disposed in a circular track, however, other rotation mechanisms are contemplated to be within the scope of the present disclosure.

Figure 4:
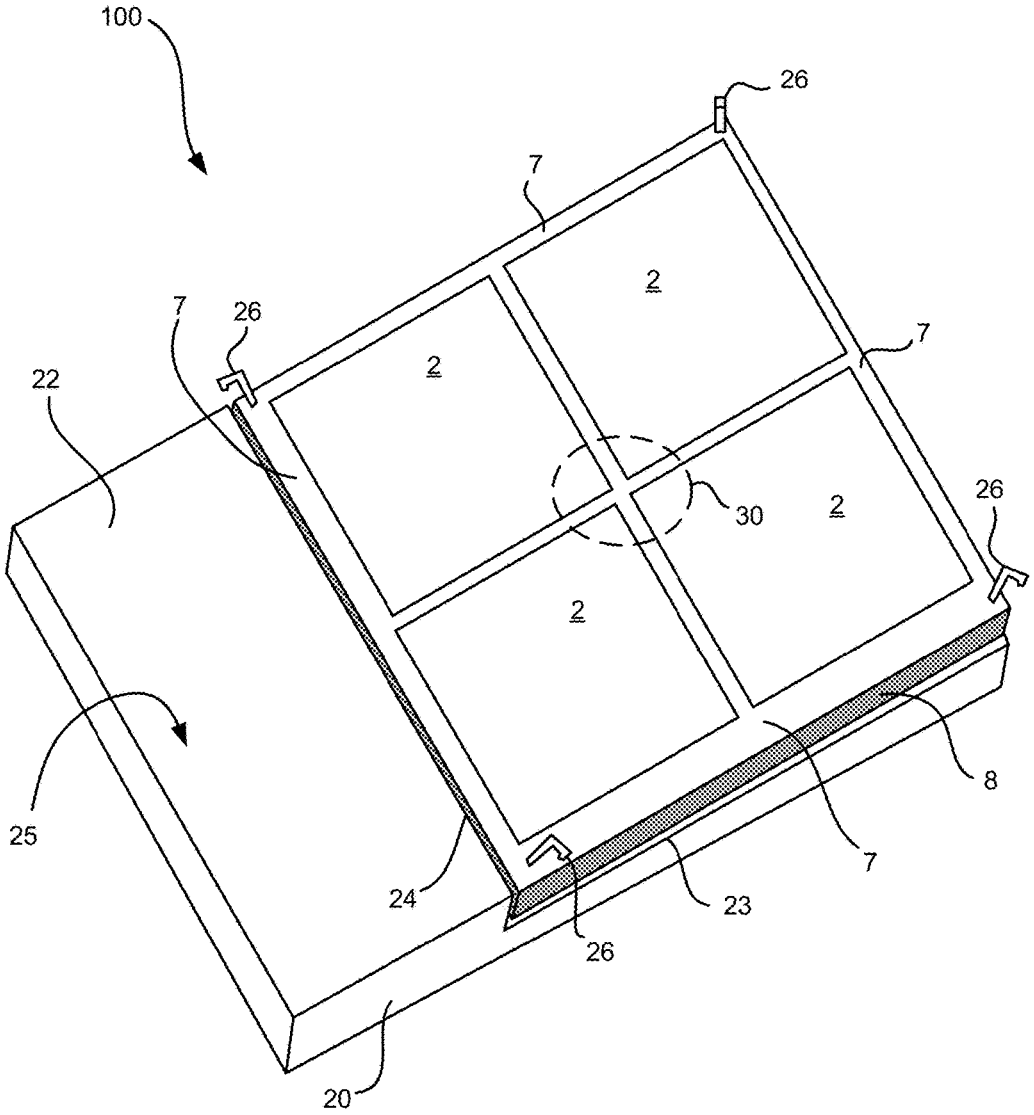
FIG. 4 is a perspective view of a multi-surface golf swing training mat in accordance with another embodiment of the present disclosure.
Figure 5A:
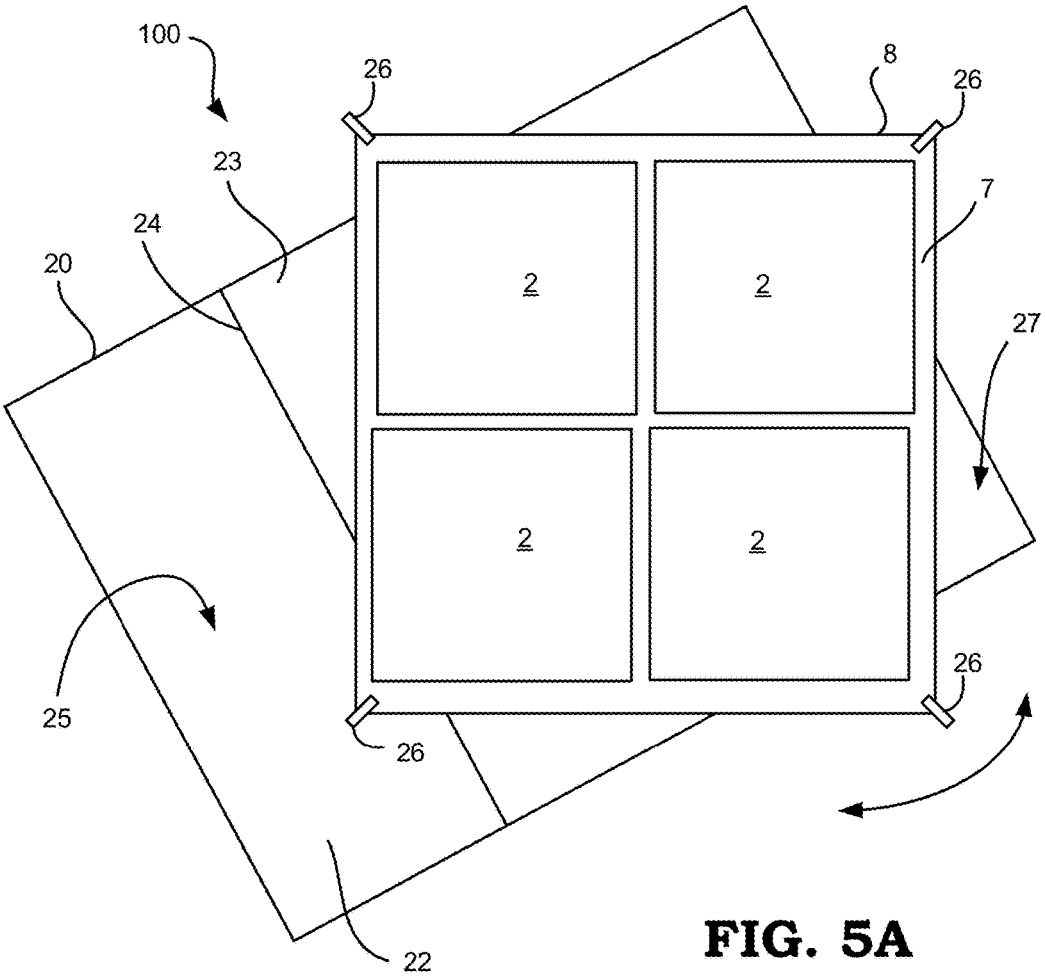
FIG. 5A is a perspective view of the multi-surface golf swing training mat as shown in FIG. 4 with the mat being rotated.
Figure 5B:
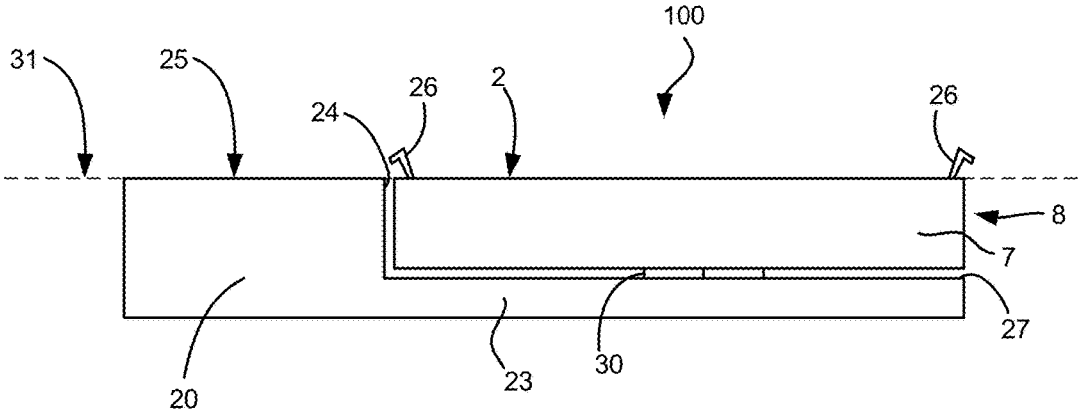
FIG. 5B is a side view of the multi-surface golf swing training mat as shown in FIG. 4.

As shown in FIGS. 4-5, platform 20 includes a standing portion 22, an indented or recessed portion 23, and a rotation mechanism 30. Standing portion 22 includes a planar surface 25 and recessed portion includes a planar surface 27, where surfaces 25 and 27 are each aligned parallel to the surface of the ground that mat 100 is placed on. Surface 27 is recessed relative to surface 25 (i.e., surface 27 is disposed more proximately to the surface of the ground than surface 25) such that an edge 24 is formed between surfaces 25, 27. Recessed portion 23 is configured to receive frame 8 such that surfaces 2*a*-2*d* are substantially aligned along the same plane 31 as planar surface 25 (i.e., surface 25 and surfaces 2*a*-*d* are substantially that same height from the ground along plane 31) and a wall 7 of frame 8 meets, contacts, or is disposed adjacent to edge 24.

Rotation mechanism 30 is disposed between frame 8 and surface 27. Rotation mechanism 30 is configured to enable frame 8 to rotate clockwise or counterclockwise relative to platform 20, as shown in FIG. 5A. It is to be appreciated that while a wall 7 of frame 8 is disposed adjacent to or in contact with edge 24, frame 8 is held in place and not rotatable relative to platform 20. In this way, a user using mat 100 is ensured that frame 8 will not move while golf balls are being hit from one of surfaces 2. To rotate frame 8, the wall 7 of frame 8 disposed adjacent to edge 24 is lifted so that the wall 7 does not meet or contact edge 24 anymore. Once the side or wall 7 contacting edge 24 is lifted, frame 8 is rotatable by a user. It is to be appreciated that the rotation mechanism may be spring-loaded to assist the golfer in lifting the frame when the frame is to be rotated.

In one embodiment, one or more engaging members 26 are coupled to frame 8 and configured to enable a user to lift and rotate frame 8 using a club head disposed at an end of the shaft of a golf club used by the user. In one embodiment, each engaging member 26 is configured as a hook such that a club head of a golf club can engage engaging member 26. In other embodiments, engaging members 26 may be configured as loops (e.g., made of nylon or other suitable materials).

Engaging member 26 may be disposed at one or more corners of frame 8. Alternatively, engaging member 26 may be disposed at a location between the corners of frame 8. In either case, engaging members 26 are oriented and placed on frame 8 such that engaging members 26 do not interfere with the usage of mat 100 (i.e., they do not interfere with a player's golf swing).

In other embodiments of the present disclosure, frame 8 may be configured in four separate portions to enable mat 10 to achieve a compact state. In this way, mat 10 takes up less space in the compacted state and may be placed in a bag or kit and easily transported.

Figure 6:
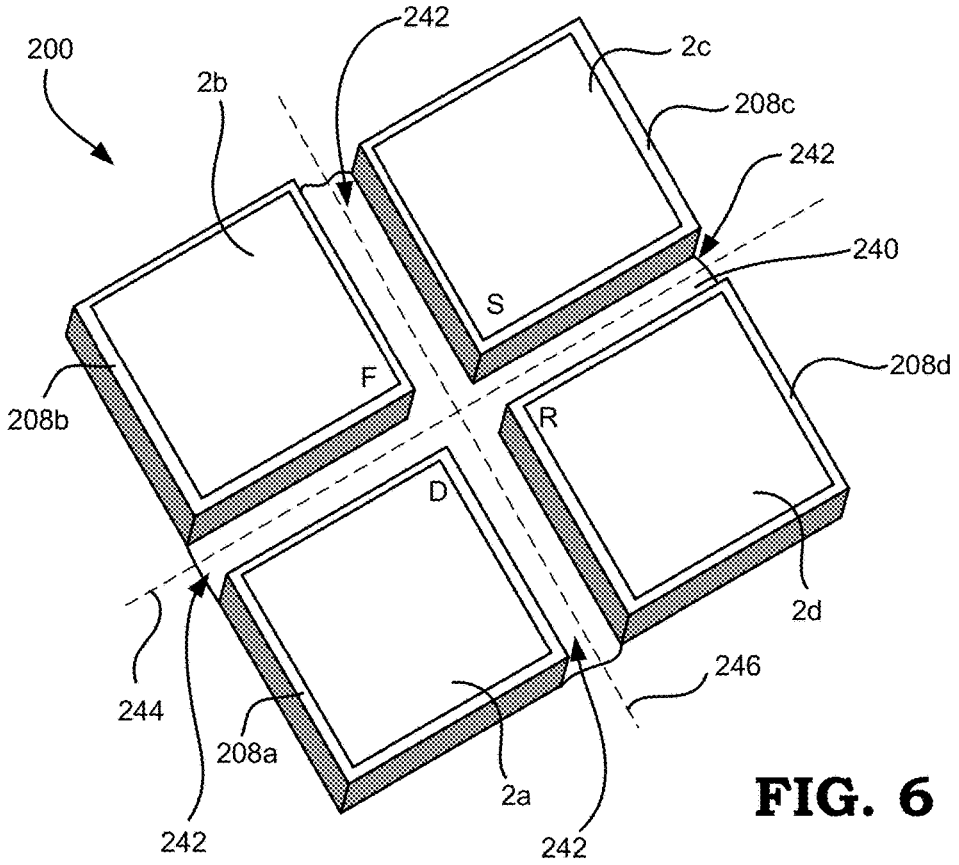
FIG. 6 is a perspective view of a multi-surface golf swing training mat in accordance with yet another embodiment of the present disclosure.
Figure 7:
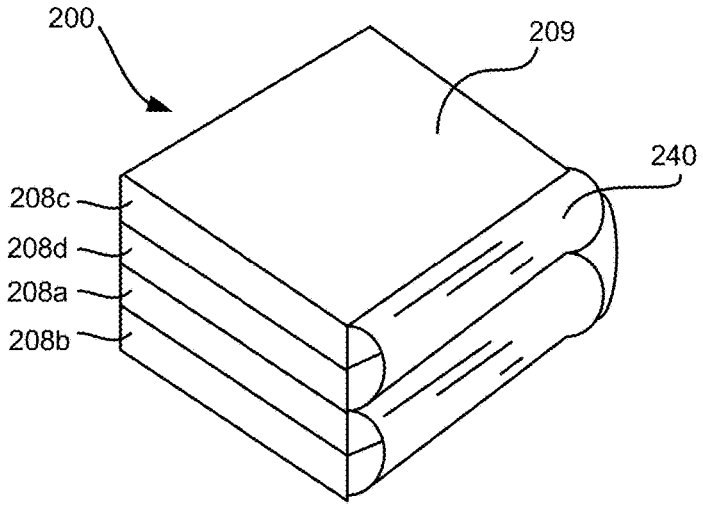
FIG. 7 illustrates the multi-surface golf swing training mat as shown in FIG. 6 being folded for storage.

For example, referring to FIGS. 6 and 7, an embodiment of mat 200, where mat 200 is foldable is shown in accordance with the present disclosure. In this embodiment, frame 8 includes four separate portions 208*a*, 208*b*, 208*c*, 208*d*. Each portion 208*a*-208*d*, is configured in a substantially square or rectangular shape and includes a slot to receive a corresponding surface 2 and support layer 4. A flexible (and, in some embodiments, elastic) material 240 is used to couple each of portions 208*a*-208*d* to each other. For example, flexible material 240 may be rubber or a flexible cloth material. In some embodiments, flexible material 240 may be coupled to two adjacent sides of each portion of portions 208*a*-208*d*, as shown in FIG. 6. In other embodiments, flexible material 240 is coupled to a bottom face or side of each of portions 208*a*-208*d* (i.e., the portions oriented toward the ground while mat 200 is in use).

As shown in FIG. 6, frame portions 208*a*-208*d* are coupled such that, while mat 200 is in use (i.e., placed on the ground and not in a folded or compacted state), frame portions 208 form and retain the square or rectangular two-by-two arrangement of surfaces 2 shown and described in the embodiments above. Flexible material 240 and frame portions 208*a*-208*d* are arranged such that gaps 242 are formed between adjacent frame portions 208. The gaps 242 and flexible material 240 are arranged such that mat 200 is foldable as many as two times. For example, mat 200 may be folded a first time about axis 244, such that, surface 2*a* and frame portion 208*a* is disposed adjacent to (i.e., stacked on top of) surface 2*b* and frame portion 208*b*, and surface 2*d* and frame portion 208*d* is disposed adjacent to (i.e., stacked on top of) surface 2*c* and frame portion 208*c*. Mat 200 may then be folded a second time about axis 246 (where axis 246 crosses axis 244) such that frame portions 208*a* and 208*b* including surfaces 2*a* and 2*b* are disposed adjacent to (i.e., stacked on top of) frame portions 208*c* and 208*d* including surface 2*c* and 2*d*. Mat 200 is shown after having been folded about axis 44 and axis 46 such that mat 200 achieves a compacted state in FIG. 7.

Figure 8:
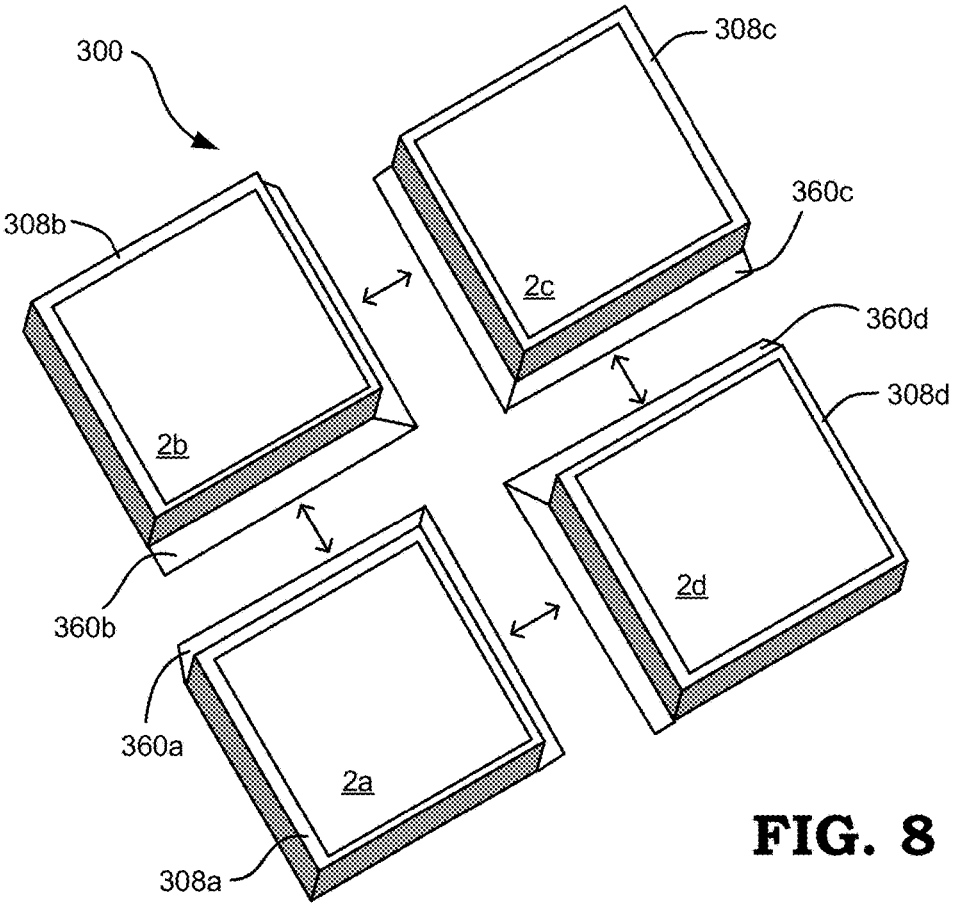
FIG. 8 is a perspective view of a multi-surface golf swing training mat in accordance with yet another embodiment of the present disclosure.

In another embodiment, frame portions 208*a*-208*d* are configured to be detachably coupled. For example, referring to FIGS. 8 and 9, a mat 300 including detachable frame portions 308*a*-308*d* is shown in accordance with the present disclosure. In this embodiment, frame 8 is separated into frame portions 308*a*-308*d*. As shown in FIG. 8, a coupling mechanism 360, such as a hook-and-loop type strip, is coupled to two adjacent sides of each of frame portions 308*a*-308*d*. Each coupling mechanism 360 is configured to enable a frame portion 308 to be detachably coupled to two other frame portions 308. For example, coupling mechanism 360*a* is configured to be detachably coupled to coupling mechanisms 360*b* and 360*d*, such that, frame portion 308*a* may be concurrently detachably coupled to frame portions 308*b* and 308*d*. Similarly, coupling mechanism 360*b* is configured to be concurrently detachably coupled to coupling mechanisms 360*c* and 360*a*, coupling mechanisms 360*c* is configured to be concurrently detachably coupled to coupling mechanisms 360*b* and 360*d*, and coupling mechanisms 360*d* is configured to be concurrently detachably coupled to coupling mechanisms 360*c* and 360*a*. In this way, while mat 300 is in use, frame portions 308*a*-308*d* may be coupled via coupling mechanisms 360 to achieve the two-by-two arrangement of surfaces 2, as described above.

Figure 9:
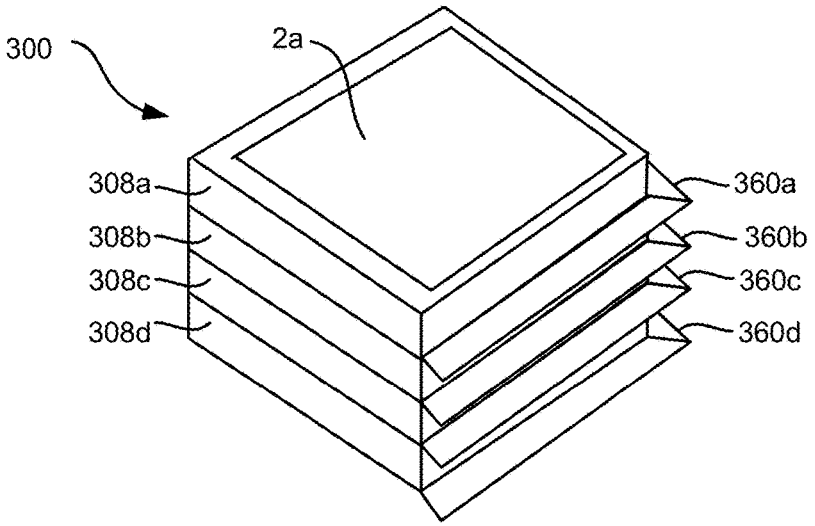
FIG. 9 illustrates the portions of the multi-surface golf swing training mat as shown in FIG. 8 stacked upon each other for storage.

When mat 300 is not in use, frame portions 308*a*-308*d* may be detached from each other and stacked into a compact state or arrangement as shown in FIG. 9. In this compacted state or arrangement, mat 300 may be placed into a bag or kit and easily transported and stored.

In another embodiment of the present disclosure, any of mats 10, 100, 200, 300 described above may include at least one wedge portion configured to change the angle and/or contours of at least a portion of any one of surfaces 2 to simulate different situations encountered on a golf course. For example, referring to FIG. 10, at least one wedge portion 50 is shown in accordance with the present disclosure. Wedge portion 50 includes sides 52, 54 and surfaces 56, 58. In one embodiment, side 52 has a first thickness and side 54 has a second thickness, where the first thickness is larger than the second thickness. In this way, surface 56 slopes or converges toward surface 58 in a direction moving from side 52 to side 54 of wedge portion 50.

Figure 11:
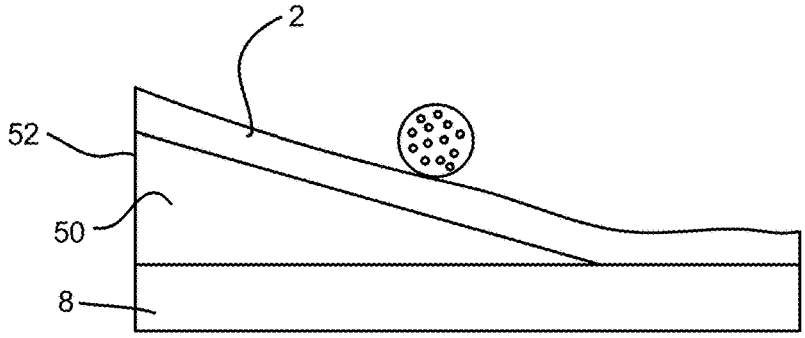
FIG. 11 is a side elevational view of a portion of the multi-surface golf swing training mat illustrating use of at least one wedge portion in accordance with an embodiment of the present disclosure.
Figure 12:
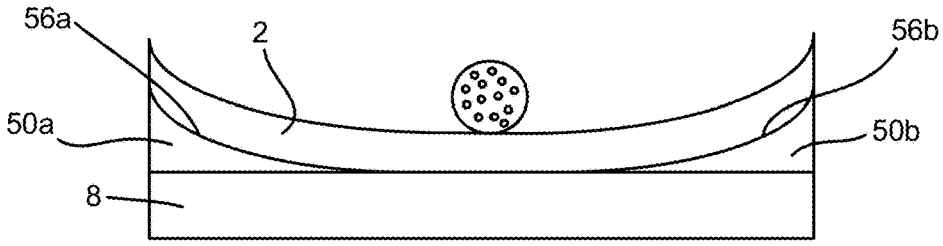
FIG. 12 is a side elevational view of a portion of the multi-surface golf swing training mat illustrating use of at least one wedge portion including a curved surface in accordance with an embodiment of the present disclosure.

Referring to FIG. 11, wedge portion 50 may be placed underneath surface 2 to change the angle of surface 2 relative to the surface of the ground that mat 10/100/200/300 is placed on. In some embodiments, each surface 2 is flexible, such that, wedge portion 50 may be placed under only a portion of surface 2 change the angle of only a portion of surface 2 relative to the surface of the ground that mat 10/100/200/300 is placed on. Referring to FIG. 12, in some embodiments, two or more wedge portions 50 may be used to change the angle of different portions of surface 2. For example, as shown in FIG. 12, surface 2 may be made to have a pattern converging toward the center of surface 2 using two wedge portions. It is to be appreciated that wedge portions 50*a* and 50*b* may also be combined into a single wedge portion in some embodiments.

In some embodiments, surface 56 of wedge portions 50 may be configured as a curved surface being either concave, convex, or a combination of the two to form a curved contoured surface. For example, in FIG. 12, surfaces 56*a*, 56*b* are each curved in a concave shape to impart a concave shape to surface 2.

It is to be appreciated that wedge portion may be a separate component of mat 10/100/200/300 disposed between surface 2 and support layer 4 or disposed between support layer 4 and floor or surface 9 of frame 8 (shown in FIG. 2). Alternatively, wedge portion 50 may be integrated into a surface of support layer 4 that is oriented toward surface 2.

Figure 13:
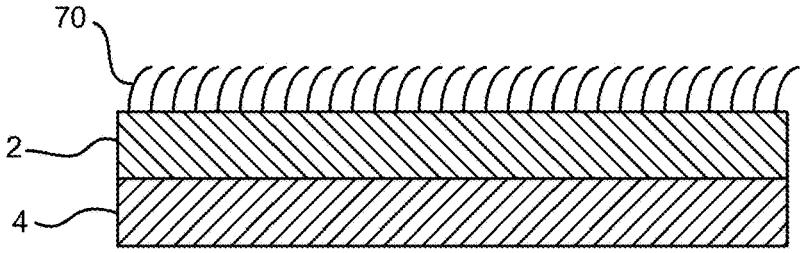
FIG. 13 is a cross-section view of a surface and support layer of the multi-surface golf swing training mat is shown in accordance with an embodiment of the present disclosure.

It is to be appreciated that in each of the embodiments described above, each surface 2 is removable from its corresponding slot 6 of frame 8. In this way each surface 2 may be replaced as needed. The simulated grass of each surfaces 2*a*, 2*b*, 2*c* may extend at a slanted angle (i.e., not perpendicularly) from surface 2 to simulate different grass or lie patterns encountered on a golf course. For example, referring to FIG. 13, a cross-section view of a surface 2 and support layer 4 is shown in accordance with an embodiment of the present disclosure. As shown in FIG. 13, artificial or simulated grass 70 extends from surface 2. It is to be appreciated that surface 2 shown in FIG. 13 may represent any one of surface 2*a*, 2*b*, 2*c* (since only the thickness, density, height of the grass varies between each of surface 2*a*, 2*b*, 2*c*).

Although normally, the grass 70 is configured to extend perpendicularly from surface 2 to simulate ideal conditions on a golf course, in some embodiments, the grass 70 is configured to extend from surface 2 at a predetermined angle (e.g., 30 degrees, 50, degrees, 75 degrees, etc.) to simulate the changing lie found in various portions of a golf course.

Figure 14:
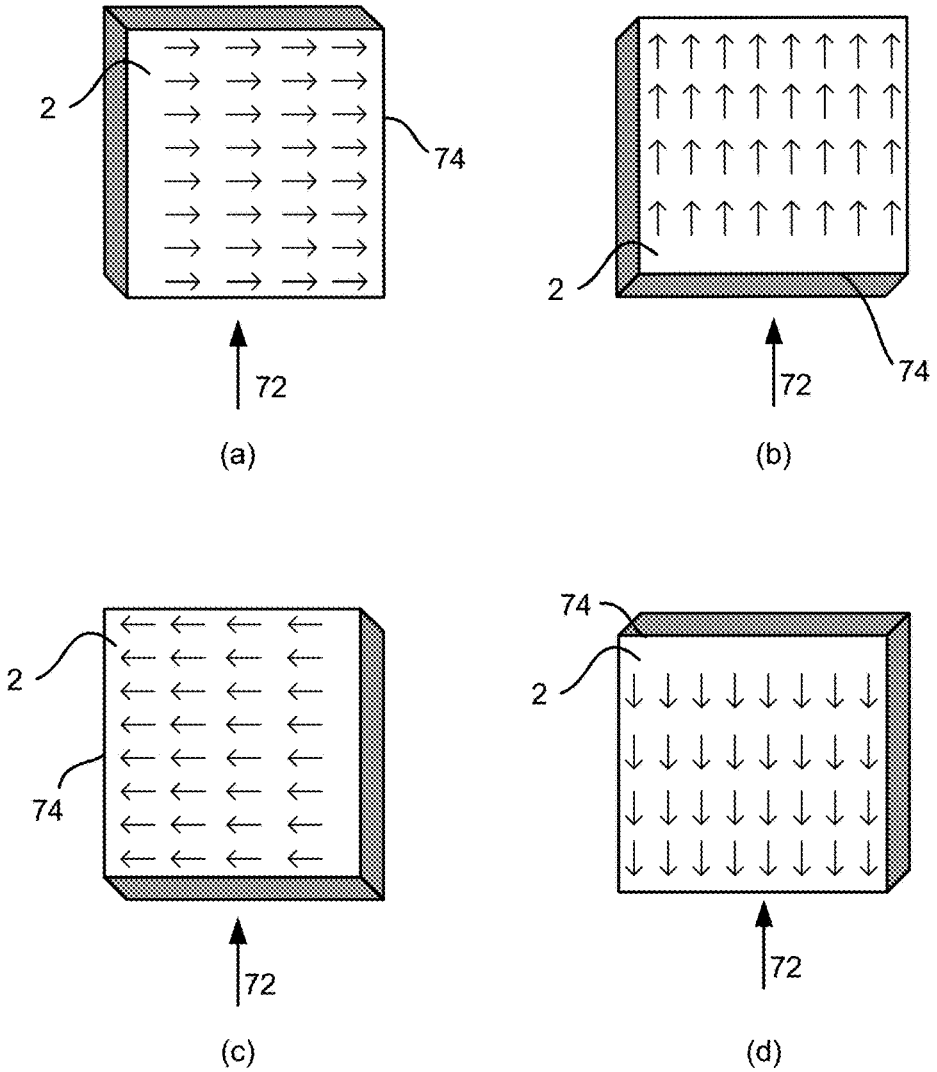
FIGS. 14 and 15 are top views of surfaces of the multi-surface golf swing training mat with simulated grass of a particular surface being slanted in different directions relative to a direction of a golf swing in accordance with an embodiment of the present disclosure.
Figure 15:
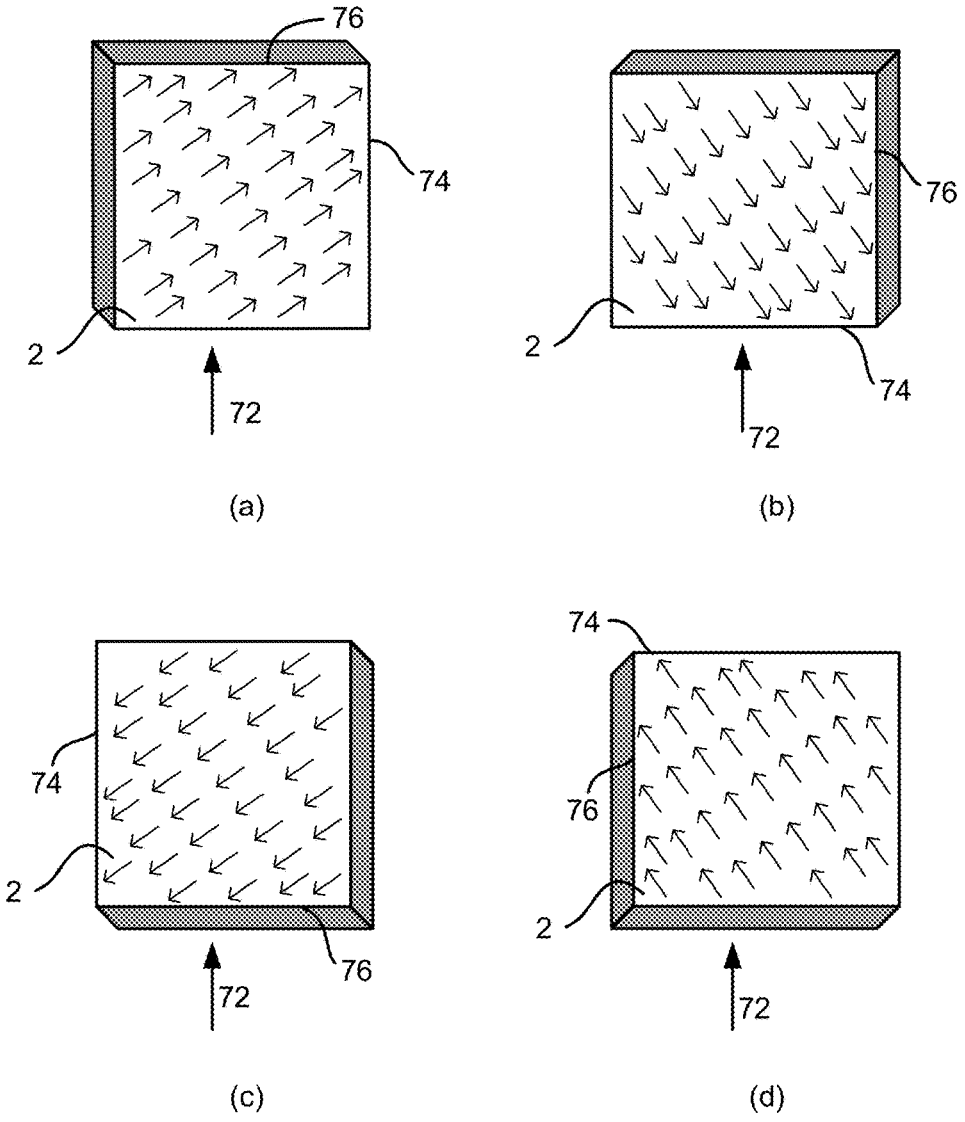

Since, as stated above, each surface 2 is replaceable, the surface 2 may be removed from its slot 6 of frame 8 (shown in FIG. 2), rotated 90 degrees, and placed back in its slot 6 of frame 8 to simulate hitting with, against, or at angles to slanted grass (i.e., grass that extends from surface 2 at an angle). For example, referring to FIG. 14, in one embodiment, the grass 70 is slanted at an angle relative to surface 2 and oriented toward a side 74 of surface 2, as indicated by the arrows on surface 2 shown in FIG. 14*a*. Surface 2 may be removed from frame 8 and rotated 90 degrees to simulate hitting a golf ball with the grass being slanted in an orientation being in the same direction as a golf swing (where the direction of a golf swing is shown by the arrow labelled 72) as shown in FIG. 14(*b*), at a perpendicular direction to the golf swing as shown in FIG. 14(*c*), or in an opposite direction to the golf swing as shown in FIG. 14(*d*). In another embodiment shown in FIG. 15, grass 70 may be slanted and oriented in a direction between adjacent sides 74 and 76 of surface 2. As shown in FIG. 15, surface 2 may be rotated as desired and placed in slot 6 of frame 8 to simulate hitting a golf ball with the grass 70 slanted at various diagonal orientations relative to the direction of a golf swing, as indicated by arrow 72, as shown in FIGS. 15*a*-*d*.

Figure 10:
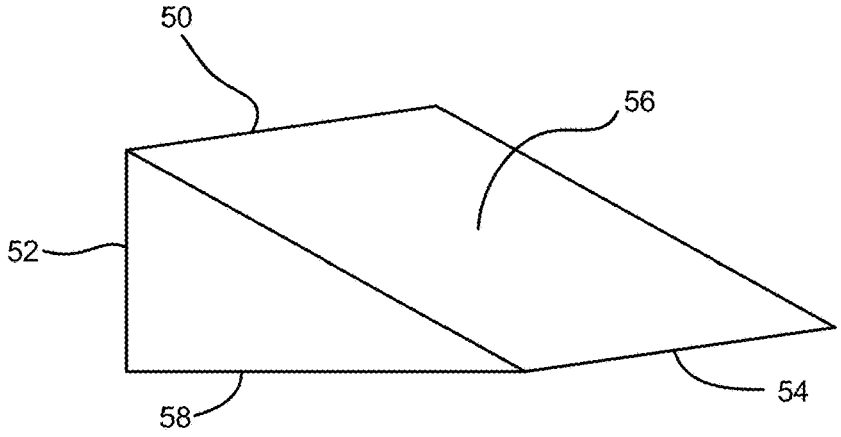
FIG. 10 is a perspective view of a wedge portion of a multi-surface golf swing training mat in accordance with an embodiment of the present disclosure.

It is to be appreciated that the embodiments of FIGS. 10-12 (i.e., including wedge portions 50) and FIGS. 13-14 (i.e., including slanted grass 70) are applicable to each of mats 10/100/200/300 described above, since, in each of mats 10/100/200/300, surfaces 2 (and support layers 4) are removable.

It is to be appreciated that the various features shown and described are interchangeable, that is, a feature shown in one embodiment may be incorporated into another embodiment.

While the disclosure has been shown and described with reference to certain preferred embodiments thereof, it will be understood by those skilled in the art that various changes in form and detail may be made therein without departing from the spirit and scope of the disclosure as defined by the appended claims.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. A multi-surface golf swing training mat comprising: a first surface configured to simulate a tee-box portion of a golf course, the first surface including simulated grass of a first predetermined height; a second surface configured to simulate a fairway portion of the golf course, the second surface including simulated grass of a second predetermined height; a third surface configured to simulate a rough portion of the golf course, the third surface including simulated grass of a third predetermined height, wherein the second predetermined height is greater than the first predetermined height and the third predetermined height is greater than the first and second predetermined heights; a fourth surface configured to simulate a bunker portion of the golf course; a frame configured to receive the first, second, third, and fourth surfaces such that a generally rectangular shape is formed with the first, second, third, and fourth surfaces being in a two-by-two arrangement; a platform including a standing portion and a recessed portion, the standing portion including a surface for a user to stand on and the recessed portion configured to receive the frame such that the first, second, third, and fourth surfaces are the same height from the ground as the surface of the standing portion, wherein the frame is configured to be rotatable relative to the standing portion via a rotation mechanism to select a different combination of two surfaces in the two-by-two arrangement to be disposed adjacent to the standing portion, wherein to rotate the frame, one of four sides of the frame that is in contact with an edge of the platform is lifted to enable the frame to be rotated.

2. The multi-surface golf swing training mat of claim 1, wherein the rotation mechanism is spring loaded.

3. The multi-surface golf swing training mat of claim 1, wherein the frame includes four sides and an edge is formed between the standing portion and the recessed portion of the platform such that when any one of the four sides of the frame is in contact with the edge the frame is not rotatable.

4. The multi-surface golf swing training mat of claim 1, further comprising at least one engaging member coupled to the frame, the at least one engaging member configured to enable the one of the four sides in contact with the edge to be lifted and the frame to be rotated by engaging the engaging member with a head of a golf club.

5. The multi-surface golf swing training mat of claim 4, wherein the engaging member is configured as a hook.

6. The multi-surface golf swing training mat of claim 1, wherein the fourth surface includes a lip defining an indented portion, the indented portion configured to be filled with a first material, the first material being at least one of sand or a material simulating sand.

7. The multi-surface golf swing training mat of claim 6, further comprising a lid configured to be placed over the lip to retain the first material within the indented portion of the fourth surface.

8. The multi-surface golf swing training mat of claim 7, wherein the lid and lip each include coupling mechanisms configured to detachably couple the lid and lip to each other.

9. The multi-surface golf swing training mat of claim 1, further comprising at least one wedge configured to be placed underneath any one of the first, second, third, and fourth surfaces, the at least one wedge configured to change an angle of at least a portion of the first, second, third, or fourth surfaces relative to a surface the multi-surface golf swing training mat is placed on.

10. The multi-surface golf swing training mat of claim 1, further comprising at least one wedge configured to be placed underneath any one of the first, second, and third surfaces, the at least one wedge configured to impart a curved shape to at least a portion of the first, second, or third surfaces.

11. The multi-surface golf swing training mat of claim 1, wherein the simulated grass of each of the first, second, and third surface is made of artificial turf.

12. The multi-surface golf swing training mat of claim 1, wherein the first, second, third, and fourth surfaces are each underlain by a support layer configured to simulate dirt and provide support to each of the surfaces.

13. The multi-surface golf swing training mat of the claim 1, wherein the frame is made of a rigid material and includes four slots, each slot configured to receive a respective one of the first, second, third, and fourth surfaces.

14. A multi-surface golf swing training mat comprising: a first surface configured to simulate a tee-box portion of a golf course, the first surface including simulated grass of a first predetermined height; a second surface configured to simulate a fairway portion of the golf course, the second surface including simulated grass of a second predetermined height; a third surface configured to simulate a rough portion of the golf course, the third surface including simulated grass of a third predetermined height, wherein the second predetermined height is greater than the first predetermined height and the third predetermined height is greater than the first and second predetermined heights; a fourth surface configured to simulate a bunker portion of the golf course, the fourth surface including a lip defining an indented portion, the indented portion configured to be filled with a first material, the first material being at least one of sand or a material simulating sand; and a lid configured to be placed over the lip to retain the first material within the indented portion of the fourth surface, wherein the lid includes a protrusion configured to partially extend into the indented portion to seal the first material in the indented portion; and a frame configured to receive the first, second, third, and fourth surfaces such that a generally rectangular shape is formed with the first, second, third, and fourth surfaces being in a two-by-two arrangement.

15. The multi-surface golf swing training mat of claim 14, wherein the frame includes a first portion configured to receive the first surface, a second portion configured to receive the second surface, a third portion configured to receive the third surface, and a fourth portion configured to receive the fourth surface, wherein the first, second, third, and fourth portions of the frame are coupled together via a flexible material configured to enable the frame to be folded into a compact structure.

16. The multi-surface golf swing training mat of claim 14, wherein the frame includes a first portion configured to receive the first surface, a second portion configured to receive the second surface, a third portion configured to receive the third surface, and a fourth portion configured to receive the fourth surface, wherein the first, second, third, and fourth portions of the frame are detachably coupled.

17. The multi-surface golf swing training mat of claim 16, wherein each portion of the frame includes four sides and two adjacent sides of each portion include a detachable coupling mechanism to enable the first, second, third, and fourth portions of the frame to be detachably coupled.

18. A multi-surface golf swing training mat comprising: a first surface configured to simulate a tee-box portion of a golf course, the first surface including simulated grass of a first predetermined height; a second surface configured to simulate a fairway portion of the golf course, the second surface including simulated grass of a second predetermined height; a third surface configured to simulate a rough portion of the golf course, the third surface including simulated grass of a third predetermined height, wherein the second predetermined height is greater than the first predetermined height and the third predetermined height is greater than the first and second predetermined heights; a fourth surface configured to simulate a bunker portion of the golf course; a frame configured to receive the first, second, third, and fourth surfaces such that a generally rectangular shape is formed with the first, second, third, and fourth surfaces being in a two-by-two arrangement; and a platform including a standing portion and a recessed portion, the standing portion including a surface for a user to stand on and the recessed portion configured to receive the frame such that the first, second, third, and fourth surfaces are the same height from the ground as the surface of the standing portion, the platform including a rotation mechanism, the rotation mechanism coupled to a portion of the frame such that the frame is rotatable relative to the platform, wherein the frame includes four sides and an edge is formed between the standing portion and the recessed portion of the platform such that when any one of the four sides of the frame is in contact with the edge the frame is not rotatable, wherein to rotate the frame, one of the four sides that is in contact with the edge is lifted to enable the frame to be rotated.

* * * * *